US009014611B2

(12) United States Patent
Ishii et al.

(10) Patent No.: US 9,014,611 B2
(45) Date of Patent: Apr. 21, 2015

(54) FIXING DEVICE AND IMAGE FORMING APPARATUS WITH SAME

(71) Applicants: Kenji Ishii, Kanagawa (JP); Hiromasa Takagi, Tokyo (JP); Arinobu Yoshiura, Kanagawa (JP)

(72) Inventors: Kenji Ishii, Kanagawa (JP); Hiromasa Takagi, Tokyo (JP); Arinobu Yoshiura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/175,281

(22) Filed: Feb. 7, 2014

(65) Prior Publication Data

US 2014/0241766 A1 Aug. 28, 2014

(30) Foreign Application Priority Data

Feb. 25, 2013 (JP) ..... 2013-034597
Dec. 24, 2013 (JP) ..... 2013-265525

(51) Int. Cl.
*G03G 15/20* (2006.01)

(52) U.S. Cl.
CPC ..... *G03G 15/2025* (2013.01); *G03G 15/2053* (2013.01); *G03G 2215/2035* (2013.01)

(58) Field of Classification Search
CPC ..... G03G 15/2025; G03G 15/2035; G03G 15/2075
USPC ..... 399/328, 329
See application file for complete search history.

(56) References Cited

U.S. PATENT DOCUMENTS

| | | | | |
|---|---|---|---|---|
| 2005/0147436 | A1 | 7/2005 | Koyama et al. | |
| 2008/0095557 | A1* | 4/2008 | Horie | 399/329 |
| 2009/0052958 | A1* | 2/2009 | Okuno et al. | 399/329 |
| 2011/0076071 | A1 | 3/2011 | Yamaguchi et al. | |
| 2011/0116848 | A1 | 5/2011 | Yamaguchi et al. | |
| 2012/0121303 | A1 | 5/2012 | Takagi et al. | |
| 2012/0121304 | A1 | 5/2012 | Tokuda et al. | |
| 2012/0121305 | A1 | 5/2012 | Yoshikawa et al. | |
| 2012/0148303 | A1 | 6/2012 | Yamaguchi et al. | |
| 2012/0155935 | A1 | 6/2012 | Yoshikawa et al. | |
| 2012/0155936 | A1 | 6/2012 | Yamaguchi et al. | |
| 2013/0195525 | A1 | 1/2013 | Murdock et al. | |
| 2013/0195523 | A1 | 8/2013 | Yamaji et al. | |
| 2013/0251390 | A1 | 9/2013 | Ishii et al. | |
| 2013/0266355 | A1 | 10/2013 | Yoshiura et al. | |
| 2014/0064804 | A1* | 3/2014 | Yamaguchi et al. | 399/329 |

FOREIGN PATENT DOCUMENTS

| | | |
|---|---|---|
| JP | 5-208473 | 8/1993 |
| JP | 10-157875 | 6/1998 |
| JP | 10-273252 | 10/1998 |

(Continued)

*Primary Examiner* — Gregory H Curran
(74) *Attorney, Agent, or Firm* — Oblon, McClelland, Maier & Neustadt, L.L.P.

(57) ABSTRACT

A fixing device fixes an unfixed image onto a recording medium by heating the recording medium conveyed to a fixing nip. The fixing device includes a rotator, a belt rotatable by contacting the rotator, and a fixing nip-forming member provided inside a loop of the fixing belt to together form the fixing nip with the rotator via the fixing belt. A sliding pad is placed between the fixing nip-forming member and the fixing belt to retain lubricant and render the fixing belt to smoothly slide thereon. The sliding pad includes a first fibrous layer contacting the fixing belt and a second fibrous layer closer to the fixing nip-forming member than the first fibrous layer. The second fibrous layer has less fiber density than the first fibrous layer.

17 Claims, 7 Drawing Sheets

(56) References Cited

FOREIGN PATENT DOCUMENTS

| | | |
|---|---|---|
| JP | 2000-135797 | 5/2000 |
| JP | 2005-066921 | 3/2005 |
| JP | 2005-202374 | 7/2005 |
| JP | 2011-107729 | 6/2011 |
| JP | 2012-068491 | 4/2012 |

* cited by examiner

FIXING DEVICE AND IMAGE FORMING APPARATUS WITH SAME

CROSS-REFERENCE TO RELATED APPLICATIONS

This patent application is based on and claims priority pursuant to 35 U.S.C. §119 to Japanese Patent Application Nos. 2013-034597, filed on Feb. 25, 2013, and 2013-265525, filed on Dec. 24, 2013, in the Japan Patent Office, the entire disclosures of which are hereby incorporated by reference herein.

BACKGROUND

1. Technical Field

This invention relates to a fixing device and an image forming apparatus with the fixing device, and in particular, to a durable fixing device capable of fixing an unfixed image onto a recording medium and an image forming apparatus with the fixing device.

2. Related Art

In general, a fixing device used in an image forming apparatus, such as a copier, a facsimile, a printer, etc., includes a fixing roller heated by a heat source and a pressing roller brought in pressure contact with the fixing roller. A fixing nip is formed between the fixing roller and the pressing roller to allow a recording medium, on which an unfixed image is formed, to pass therethrough. When the recording medium passes through the fixing nip, the unfixed image on the recording medium is pressed and heated by the pressing roller and the fixing roller, and thereby fixed onto the recording medium.

In response to growing demand for energy efficiency and a shortening of the waiting time required to heat the fixing device up to a prescribed operating level (e.g. a warm-up time and a time to first print, or first-print time), a so-called on-demand type fixing device that employs an endless belt such as a thin film or the like instead of a heating roller has been widely adopted. The on-demand type-fixing device reduces a heat capacity and upgrades effectiveness of heat transfer to the recording medium, while shortening the waiting time.

Specifically, in this type of a fixing device, a nip-forming member contacts an inner circumferential surface of a fixing belt. A rotator (e.g., a pressing roller) acting as a driving source is pressed against the fixing nip-forming member via a fixing belt, thereby forming a fixing nip between the fixing belt and the rotator. The recording medium is subsequently conveyed into the fixing nip to fix an unfixed toner image onto the recording medium.

In such a fixing device, since the fixing belt is pressed against the fixing nip-forming member by the rotator and is moved with its inner circumferential surface contacting the fixing nip-forming member, the fixing belt and the fixing nip-forming member are easily worn out.

Further, when friction between the fixing belt and the fixing nip-forming member increases in the fixing device, driving motor a torque to drive the rotator accordingly increases, thereby causing the rotator to slip and be unable to drive the fixing belt in the fixing device. As a result, the recording medium passing through the fixing nip is subjected to unstable braking and is wrinkled.

Further, once the driving motor becomes unable to bear a load, it seizes up and stops rotating.

Further still, the number of pulses inputted to the driving motor does not correspond to an actual rotation number of the driving motor resulting in a loss of synchronism Known systems insert a sliding pad retaining lubricant between an inner circumferential surface of a fixing belt and a nip-forming member to render the fixing belt to smoothly slide thereon.

For example, a porous resin fiber woven fabric or a porous resin member prepared by laminating a porous resin film on a surface of the porous plastic fiber woven fabric and silicone oil are conventionally employed as the sliding pad and the lubricant, respectively.

Accordingly, a sheet-like sliding member prepared by laminating a deformation prevention film that prevents deformation of a porous material on a non-sliding surface of the porous material and silicone oil are also conventionally employed as the sliding pad and the lubricant, respectively.

However, since vacancies in the conventional porous resin member and the sheet-like sliding member are crushed by pressure during image fixation, and accordingly, the lubricant is squeezed out, the lubricant is not retained for a long time. At the same time, the fixing belt type-fixing device needs to be steadily and constantly driven for a long time. Thus, the sliding pad needs to better lubricant retention.

SUMMARY

Accordingly, one aspect of the present invention provides a novel fixing device to fix an unfixed image onto a recording medium by heating the recording medium conveyed to a fixing nip. Such a novel fixing device includes: a rotator; a belt rotatable by contacting the rotator; a nip-forming member provided inside a loop of the fixing belt to together form the fixing nip with the rotator via the fixing belt; and a sliding pad placed between the fixing nip-forming member and the fixing belt to retain lubricant and render the fixing belt to smoothly slide thereon. The sliding pad includes: a first fibrous layer contacting the fixing belt; and a second fibrous layer closer to the fixing nip-forming member than the first fibrous layer. The second fibrous layer has less fiber density than the first fibrous layer.

Another aspect of the present invention provides a novel image forming apparatus that includes an image forming system to form an unfixed image and the above-described fixing device.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 1:
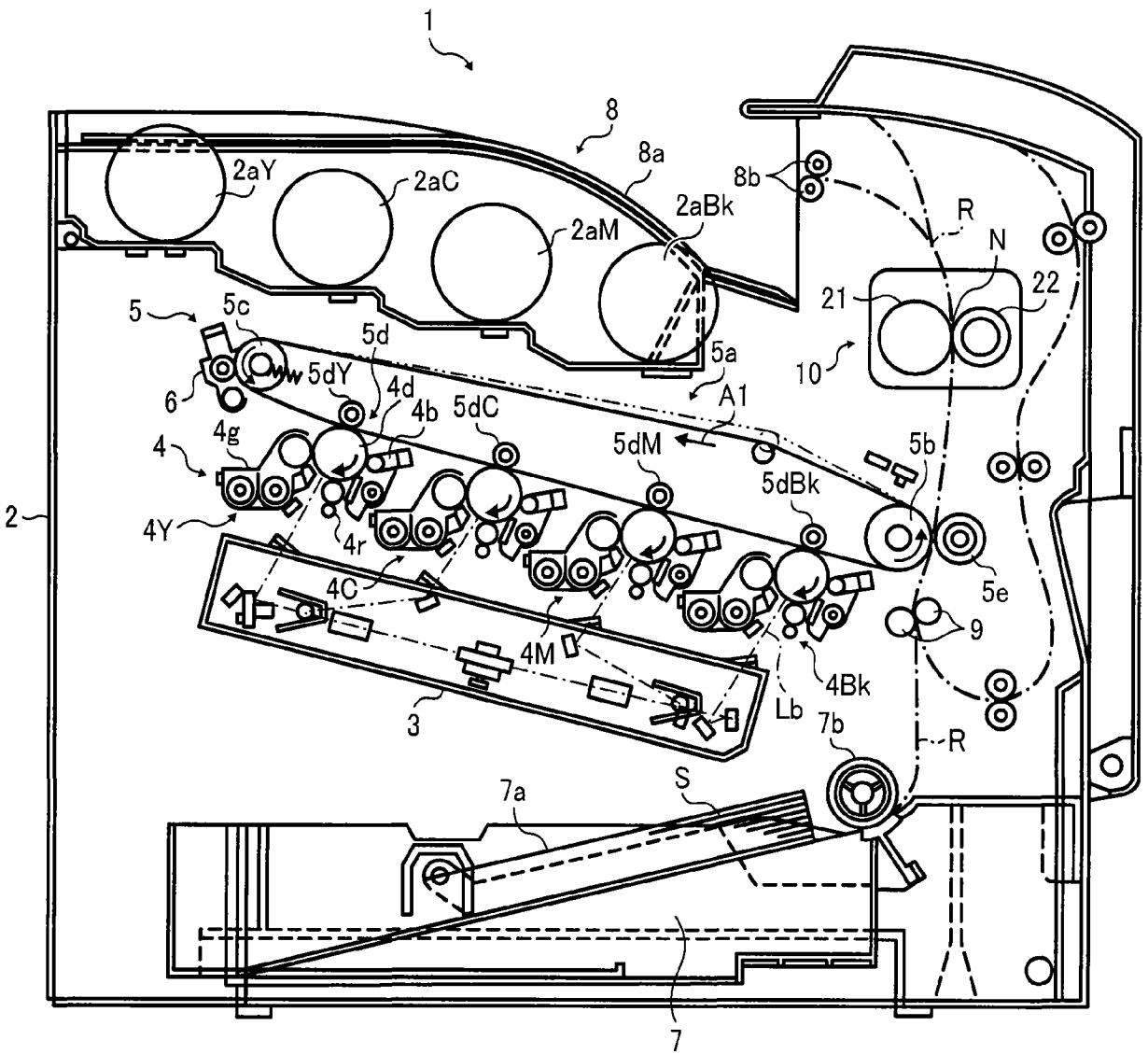
FIG. 1 is a schematic cross-sectional view illustrating an interior of an image forming apparatus with a fixing device according to a first embodiment of the present invention.

Referring now to the drawings, wherein like reference numerals designate identical or corresponding parts throughout the several views thereof and in particular to FIGS. 1 to 7, a first embodiment is initially described. Specifically, FIGS. 1 to 7 illustrate a fixing device and a color image forming apparatus as a typical example of an image forming apparatus with the fixing device according to the first embodiment of the present invention.

As shown in FIG. 1, the color image forming apparatus 1 according to this embodiment includes an apparatus body 2, an optical writing system 3, a process unit 4, a (intermediate) transferring system 5, a belt cleaning device 6, a sheet feeding device 7, a sheet exiting tray unit 8, a registration roller 9, and a fixing device 10.

The color image forming apparatus 1 includes a tandem structure configured by juxtaposing multiple photoconductive drums composed of image carriers which form color images of component colors separated to yellow (Y), cyan (C), magenta (M), and black (Bk).

However, it is to be noted that the image forming apparatus according to this invention is not limited to the tandem structure, and the other structure can be employed as well. Further, the image forming apparatus according to this invention is not limited to the color image forming apparatus 1, and the other types of image forming apparatuses can be employed as well.

Here, the apparatus body 2 is configured by a housing to accommodate various components. Further, a sheet-conveying path R to convey a recording sheet S as a recording medium stored in the sheet-feeding device 7 is included in the housing.

To the apparatus body 2, multiple toner bottles 2*a*Y, 2*a*C, 2*a*M, and 2*a*Bk, in which yellow, cyan, magenta, and black color toner particles are filled, respectively, are detachably attached below the sheet exiting tray unit 8. Further, inside the apparatus body 2, a waste toner container, not shown, is provided. To an entrance of the waste toner container, a hose is connected to transfer and accommodate waste toner therein.

The optical writing system 3 is configured by including a semiconductor laser as a light source, a coupling lens, an fθ lens, a toroidal lens, a folding mirror, and a rotating polygonal mirror, each not shown.

The optical writing unit 3 is configured to form an electrostatic latent image in process units 4 by irradiating writing light beams Lb corresponding to respective component colors. Such image information included in each of the laser light beams is configured by monochromatic image information obtained by separating a full-color of an image into respective components colors of yellow, cyan, magenta, and black.

The process unit 4 is composed of four process units 4Y, 4C, 4M, and 4Bk. For example, the process unit 4Y typically includes a photoconductive drum 4*d*, a charging roller 4*r*, a developing device 4*g*, and a cleaning blade 4*b*. The process unit 4Y is configured to execute respective processes of charging, optical writing, developing, transferring, cleaning, and electric charge removing.

In this process unit 4Y, first of all, the electric charging process is applied to the photoconductive drum 4*d* by the charging roller 4*r* to provide static electricity thereon, and the optical writing process is subsequently applied by the optical writing system 3 onto a surface of the charged photoconductive drum 4*d* to form an electrostatic latent image having a prescribed electrostatic pattern on the photoconductive drum 4*d*. Further, the developing device 4*g* provides the yellow toner to the electrostatic latent image borne on the photosensitive drum 4*d* in the developing process to form a toner image. The toner image is subsequently transferred onto a (intermediate) transferring system 5. Further, in preparation for the next transfer process, the toner remaining on the photoconductive drum 4*d* is removed by the cleaning blade 4*b*. Further, the static electricity remaining on the photoconductive drum 4*d* is also removed as well.

The photoconductive drum 4*d* includes an inorganic or organic photoconductive layer on its cylindrical surface. The charging roller 4*r* is placed near the photoconductive drum 4*d*, and discharges and provides electric charge to the photoconductive drum between the photoconductive drum 4*d* and itself.

The developing device 4*g* is configured by a supplying section to supply the yellow toner and a developing section to provide and affixes the yellow toner onto the photoconductive drum 4*d*. The cleaning blade 4*b* includes an elastic bar made of such as rubber, etc., and a toner removing member, such as a brush, etc. The developing device 4*g* is removably accommodated in the apparatus body 2.

The remaining process units 4C, 4M, and 4Bk are similarly configured and operated as the process unit 4Y as well. Specifically, onto the (intermediate) transferring system 5, the process units 4C, 4M, and 4BK transfer a cyan toner image, a magenta toner image, and a black toner image, respectively.

The (intermediate) transferring system 5 includes a transfer belt 5*a*, a driving roller 5*b*, a driven roller 5*c*, a primary transfer roller 5*d*, and a secondary transfer roller 5*e*.

The transfer belt 5*a* is configured by a so-called endless belt of a seamless type stretched with a tension and wound around the driving roller 5*b* and the driven roller 5*c*. Further, the transfer belt 5A is configured to rotate, i.e. circulate and run, in a direction as shown by arrow A1 in the drawing as the driving roller 5*b* and the driven roller 5*c* rotate.

The primary transfer roller (group) 5*d* includes multiple primary transfer rollers 5*d*Y, 5*d*C, 5*d*M, and 5*d*Bk to process the transfer belt 5 against the respective photoconductive drums 4*d* in the process units 4Y, 4M, 4C, and 4Bk. Thus, multiple primary transfer nips are accordingly formed at contact sections in which the process units 4Y, 4C, 4M, and 4Bk and the transfer belt 5A contact each other.

Further, a secondary transfer roller 5*e* is pressed against the driving roller 5*b* through the surface of the transfer belt 5*a*, so that a secondary transfer nip is formed in a contact portion in which the secondary transfer roller 5*e* and the transfer belt 5A contact each other.

Further, the fixing belt-cleaning unit 6 is positioned between the secondary transfer nip and the process unit 4Y. The belt cleaning unit 6 includes a toner removing member, not shown, to remove toner remaining on an outer circumferential surface of the transfer belt 5*a* after the transferring process executed in the secondary transfer nip. The belt cleaning unit 6 also includes a toner transfer hose to transport the waste toner removed in this way into a waste toner container.

Further, the sheet feeding device 7 is located at a bottom of the apparatus body 2 and includes a sheet feeding cassette 7*a* that stores multiple record sheets S and a sheet feeding roller 7*b*. In the sheet feeding device 7, the sheet feeding roller 7*b* extracts the recording sheets S from the sheet cassette 7*a* one by one and feeds it to the sheet conveying path R.

Further, the sheet exiting tray unit 8 is located at the top of the apparatus body 2 above the optical writing system 3 and includes a tray 8*a* to accommodate recording sheets S with recorded information thereon. The sheet exiting tray unit 8 also includes a pair of sheet exiting rollers 8*b*.

The recorded sheets S ejected by the pair of sheet exiting roller 8*b* from the sheet conveying path R in this way are sequentially stacked one at a time in the sheet exiting tray unit 8.

Further, the registration roller unit 9 is configured by a pair of rollers and adjusts a transportation time transporting a recording sheet S, which currently stays in the sheet conveying path R after it is sent by the sheet feeding roller 7*b* of the feeding device 7 thereto.

Further, a registration sensor, not shown, is disposed in the apparatus body 2 between the registration roller 9 in the sheet conveying path R and the sheet feeding roller 7*b* to detect a tip of the recording sheet S when it passes therethrough. Further, when a prescribed hour has elapsed after the registration sensor detects the tip of the recording sheet S passing therethrough, the recording sheet S strikes the registration roller 9 and temporarily stops there at the time. The registration roller 9 rotates and transports the recording sheet S while sandwiching it toward the secondary transfer nip at a prescribed timing. As the prescribed timing, a time when a full color toner image obtained by superimposing component color images reaches the secondary transfer nip as the transfer belt 5*a* rotates is exemplified.

Figure 2:
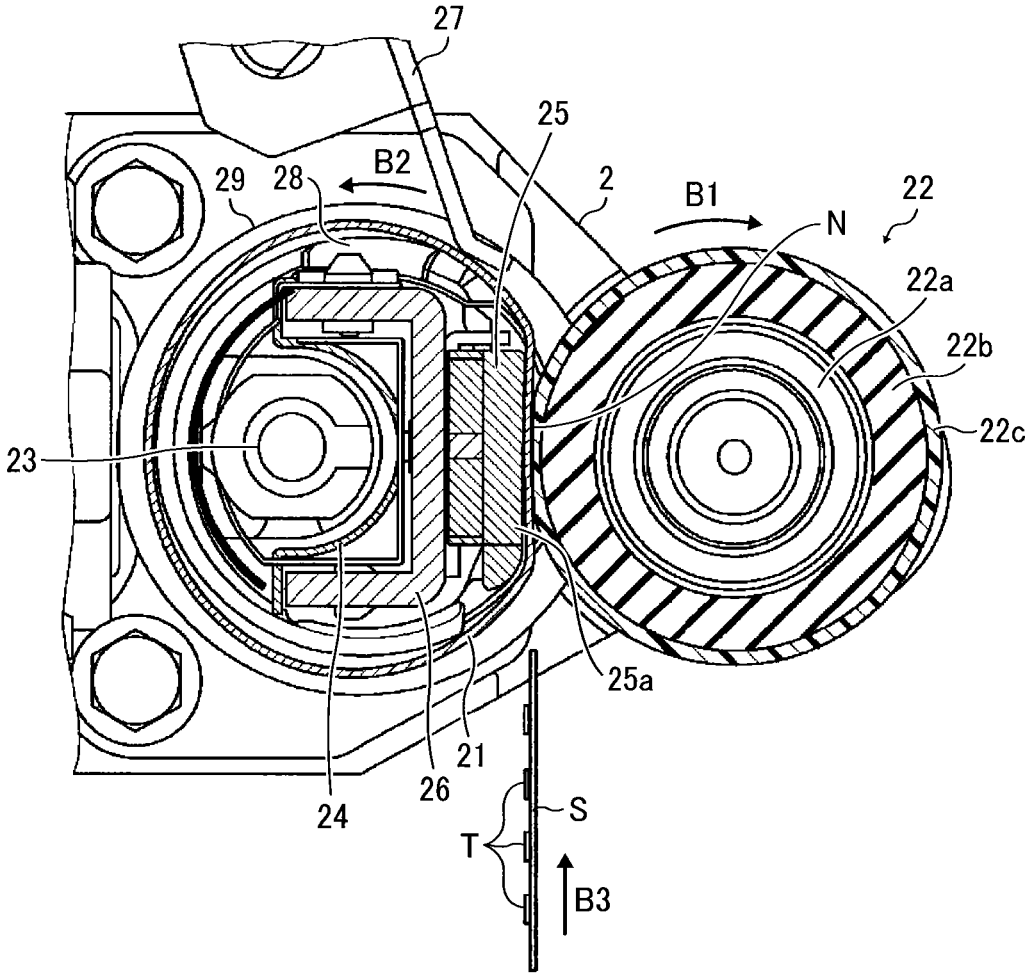
FIG. 2 is a schematic cross-sectional view illustrating an exemplary configuration of the fixing device according to the first embodiment one of the present invention.
Figure 3:
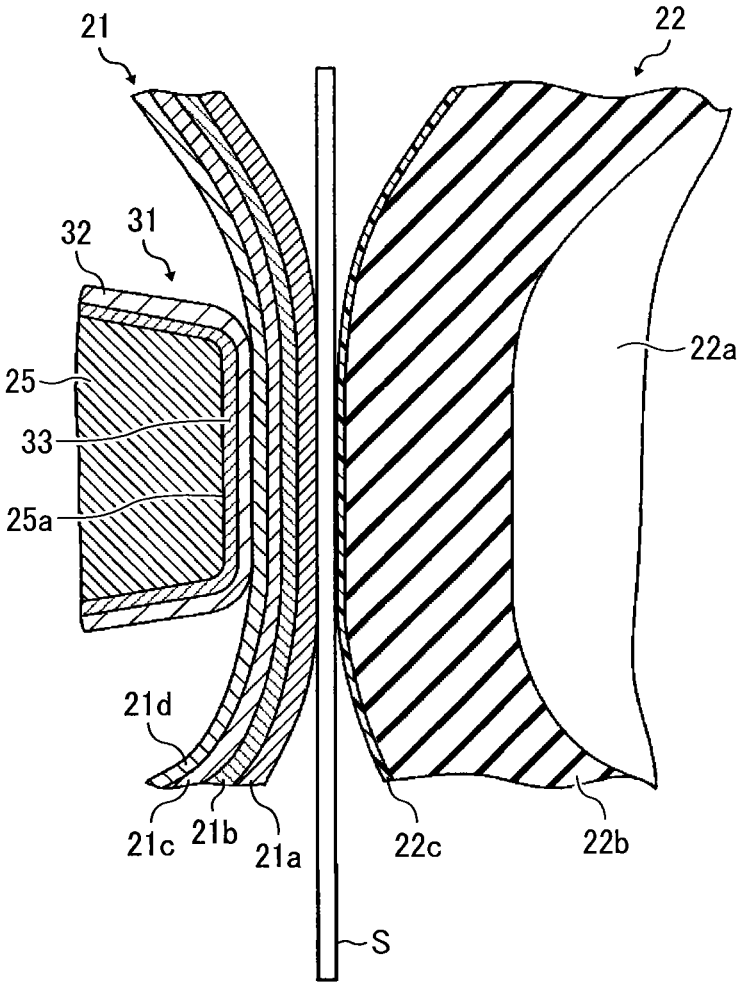
FIG. 3 is an enlarged cross-sectional view illustrating a main part of the fixing device of FIG. 2.

Further, as shown in FIGS. 2 and 3, the fixing device 10 includes a pressing roller 22 as a rotator, a fixing belt 21 driven and rotated as a fixing member disposed in contact with the pressing roller 22, and a heater 23 as a heat source. The fixing device 10 also includes a reflecting member 24, a nip-forming member 25 disposed inside a loop of an inner circumferential surface of the fixing belt 21 to together form a nip N with the pressing roller 22 through the fixing belt 21, and a supporting member 26. Further, included in the fixing device 10 are a separating member 27, a pair of supporting members 28, and a pair of protecting members 29. Furthermore, as shown in FIG. 3, the fixing device 10 also includes a sliding pad 31 placed between the fixing nip-forming member 25 and the fixing belt 21 to retain lubricant and render the fixing belt 21 to smoothly slide thereon.

In the fixing device 10, the recording sheet S is heated and pressed when passing through the fixing nip N formed between the fixing belt 21 and the pressing roller 22, so that the transferred toner image T is fixed onto the recording sheet S. Further, when it is discharged from the fixing nip N, the recording sheet S is separated from the fixing belt 21 and is conveyed toward the sheet exiting roller 8*b* through the sheet conveying path R.

Here, as shown in FIG. 3, the fixing belt 21 includes a release layer 21*a*, an elastic layer 21*b* formed on an inner circumferential surface of the release layer 21*a*, a belt base member 21*c* formed on an inner circumferential surface of the elastic layer 21*b*, and an inner surface coat layer 21*d* formed on an inner circumferential surface of the fixing belt base member 21*c*.

The fixing belt 21 is flexible and has a thickness of about 1 mm. The fixing belt 21 extends in a widthwise direction of the recording sheet S passing through the outer circumferential surface thereof. The fixing belt 21 has a ring shaped cross section perpendicular to the widthwise direction having a diameter of about 25 mm.

However, the fixing belt 21 may be configured without the elastic layer 21*b* as well. That is, when the elastic layer 21*b* is omitted, since heat capacity of the fixing belt 21 decreases, thermal response and energy saving can be upgraded at the same time. The above-described diameter of the fixing belt 21 is optionally chosen within a range from about 15 mm to approximately 120 mm in accordance with a fixing condition of the fixing device 10.

As shown in FIG. 2, the fixing belt 21 is driven and rotated in a direction as shown by arrow B2 as the pressing roller 22 rotates in a direction as shown by arrow B1 therein. Namely, the pressing roller 22 acts as a driving source of power driving the fixing belt 21. When the fixing belt 21 and the pressing roller 22 rotate, the recording sheet S enters the fixing nip N in a direction as shown by arrow B3 and is discharged from the fixing nip N.

The release layer 21*a* is made of material that provides good stripping of the recording sheet S and the toner image from the fixing belt 21. Specifically, the material has a so-called mold releasing performance capable of preventing sticking and burns of a counterpart on a surface of a toner particle and a metal mold or the like. As excellent mold releasing materials, resin, such as PFA (Tetra Fluoro ethylene-perfluoro Alkyl vinyl ether copolymer), PTFE (Poly Tetra Fluoro Ethylene), PEI (Poly-Ether Imide), PES (Poly Ether Sulphone), etc., may be specifically exemplified. The release layer 21*a* includes a thickness of from about 1 μm to about 200 μm.

The elastic layer 21*b* is made of rubber, such as silicone rubber (Q), fluorine rubber (FKM), etc., having a thickness of from about 20 μm to about 900 μm. Here, due to employment of this elastic layer 21*b*, a problem in that pressure is unevenly applied to a recording sheet S and thermal conductivity becomes uneven due to its uneven surface when it passes through the fixing nip N and is heated and pressed by a fixing belt 21 can be resolved.

Specifically, when crushing and thereby fixing an unfixed image onto the record sheet S, tiny imperfections on the fixing belt is transferred onto an image. As a result, an orange skin-like shiny unevenness (i.e., an orange skin image) remains thereon as a problem. However, with the elastic layer 21*b* having a thickness of more than about 100 micrometers, for example, tiny imperfections is absorbed by deformation of the elastic layer 21*b*, and accordingly, the problem of generating the orange skin image can be likely eliminated.

The belt base member 21*c* is made of material having a prescribed level of mechanical strength such as metal, such as nickel (Ni), stainless steel (SUS), etc., or resin such as polyimide (Polyimide) etc., each having a thickness of from about 20 μm to about 100 μm. Namely, the fixing belt base member 21*c* is composed of a thin metal film or a resin film.

The inner-coat layer 21*d* is made of, for example, fluororesin, such as PFA, PTFE, etc.

Further, as shown in FIG. 2, the pressing roller 22 includes a roller 22*a* composed of a core metal, an elastic layer 22*b* formed overlying an outer circumferential surface of the roller 22*a*, and a release layer 22*c* formed overlying an outer circumferential surface of the elastic layer 22*b*.

The pressing roller 22 is configured to rotate upon receiving driving power from a driving mechanism, not shown, provided in the apparatus body 2. The driving mechanism is configured, for example, by a driving section such as a motor, etc., and a decelerating section such as a decelerating gear, etc. Further, the pressing roller 22 is pressed by a pressing system, not shown, toward the fixing belt 21, so that the elastic layer 22*b* elastically deforms and constitutes some of the fixing nip N.

The roller 22*a* includes a prescribed level of mechanical strength and is made of metallic materials, such as carbon steel (for example, SC, STKM), aluminum (Al), etc., having an excellent thermal conductivity, and is formed into a solid cylindrical shape. Here, the roller 22*a* can be formed in a hollow cylindrical shape including a heat source such as a halogen heater, etc., therein, and is configured to heat the recording sheet S passing through the fixing nip N via the roller 22*a*, the elastic layer 22*b*, and the release layer 22*c* using the heat source.

Similar to the elastic layer 31*b* of the fixing belt 21, the elastic layer 22*b* is made of synthetic rubber, such as silicone rubber (Q), fluorocarbon rubber (FKM), etc., as well. The synthetic rubber is made of relatively rigid material not subjected to a foaming process, such as so-called solid rubber etc. When the roller 22*a* does not include the heat source inside, so-called sponge rubber having an elastic foam layer may be employed instead of the synthetic rubber. Since the sponge rubber includes air bubbles in it that enhances thermal insulation, heat of the fixing belt 21 is readily transferred to the pressing roller 22 and is rarely dissipated. As a result, energy can be further saved.

Similar to the elastic layer 21*b* of the fixing belt 21, the release layer 22*c* ensures so-called releasability and enhances durability of the elastic layer 22*b* as well. Here, the release layer 22*c* is made of material having rich durability and high thermal conductivity. For example, the release layer 22*c* is prepared by applying fluorocarbon polymer coating, such as PEI, PFA, PTFE, etc., or forming a silicone rubber layer or a fluorine rubber layer.

Here, the heater 23 is fixed to a housing inside a loop of the fixing belt 21 while separating therefrom. This heater 23 is composed of a known heat source having a single light-emitting area to directly heat the fixing belt 21 by heat radiation. Thus, the heat source is composed of a so-called radiant heater, such as a halogen heater using direct radiant heat of a halogen lamp, a carbon heater composed of a quartz tube filled with inert gas and a carbon fiber, a ceramic heater composed of ceramic with an embedded resistance wire, etc. Further, the above-described control unit controls supplying power to the heater 23.

The reflecting member 24 includes a fixed section fixed to the housing, a reflecting surface to reflect radiant heat emitted from the heater 23 toward the inner circumferential surface of the fixing belt 21, and a cover section covering a supporting member 26. The fixed section are formed at both ends in a widthwise direction of a sheet S and are secured to the housing through holders 28 at the both ends, respectively. Further, the reflecting surface has a bent in its middle portion almost surrounding and facing the heater 23 and is located between the supporting members 26 and the heater 23.

The nip-forming member 25 includes a rectangular cross section in a lengthwise direction of the recording sheet S passing through the fixing nip N and extends in a widthwise direction. The nip-forming member 25 includes a nip-forming surface 25*a* pressed against the fixing belt 21 through a sliding pad 31 and a coupler coupled to the supporting member 26. The nip-forming member 25 is placed inside the fixing belt 21 and is fixed to the housing.

Here, the fixing nip-forming surface 25*a* includes a flat surface facing the pressing roller 22 across both the fixing belt 21 and the sliding pad 31. This flat surface is thus pressed by the fixing belt 21 pressed by the pressing roller 22. Accordingly, when the pressing roller 22 presses the fixing belt 21, the elastic layer 22*b* is mainly flattened along the flat surface of the fixing nip-forming surface 25.

Thus, the deformed portion of the pressing roller 22 serves as a nip N having a given area of contact, or width.

Although in the present embodiment it is composed of the flat surface, the fixing nip-forming surface 25*a* may have a non-planar structure. For example, the fixing nip-forming surface 25*a* may be curved and recessed toward an opposite side to the pressing roller 22.

With such a curved surface, an ejection direction of a leading end of the recording sheet S passing through the fixing nip N is directed toward the pressing roller 22*nd* is easily separated from the fixing belt 21, so that so-called sheet jam, in which a recording sheet S clogs on the way of transportation is inhibited.

Similar to the fixing nip-forming member 25, the supporting member 26 extends in the widthwise direction of the recording sheet S as well. Further, a cross section of the supporting member 26 perpendicular to the widthwise direction includes an opening opened toward the heater 23. The supporting member 26 includes a supporting section supporting the fixing nip-forming member 25, a housing to accommodate the heater 23 and the reflecting member 24 in its opening, and a pair of mounting sections attached to the housing at respective widthwise side ends thereof. The supporting section 26*a* is connected to the fixing nip-forming member 25, and supports and prevents the fixing nip-forming member 25 from bending in the widthwise direction when it receives pressing force from the pressing roller 22.

Similar to the fixing nip-forming member 25, the supporting member 26 is placed inside the loop of the fixing belt 21 as well, and is attached to the housing through the respective mounting members with fasteners.

Although not shown, a separating member 27 includes a separating plate, a pair of supporting shafts to rotatably support the separating plate at its respective ends, and a compression spring to press the separating plate against the fixing belt 21. The separating member 27 contacts a tip of it and separates the recording sheet S passing through the fixing nip N from the fixing belt fixing 21.

Further, although not shown in detail, the holder 28 integrally includes a flange, a base end, and first and second projections in a unit. The nip-forming member 25 and the supporting member 6 are held by the housing via the holder 28 at respective widthwise ends of these members.

Even not shown in detail, the protecting member 29 is formed from a disc having a through hole in its middle portion. Into this through-hole, the holder 28 and the first and second protruding members are inserted. The protecting member 29 is attached to the base end of the holder 28 and together regulate movement of the fixing belt 21 in the widthwise direction of the recording sheet S with the base end thereof.

Since the side of the fixing belt 21 hits and circulates in contact with a flat side surface of the protecting member 29 and is possibly damaged thereby, the flat side surface is made of elastic material with a smooth surface having a relatively small friction coefficient.

Figure 4:
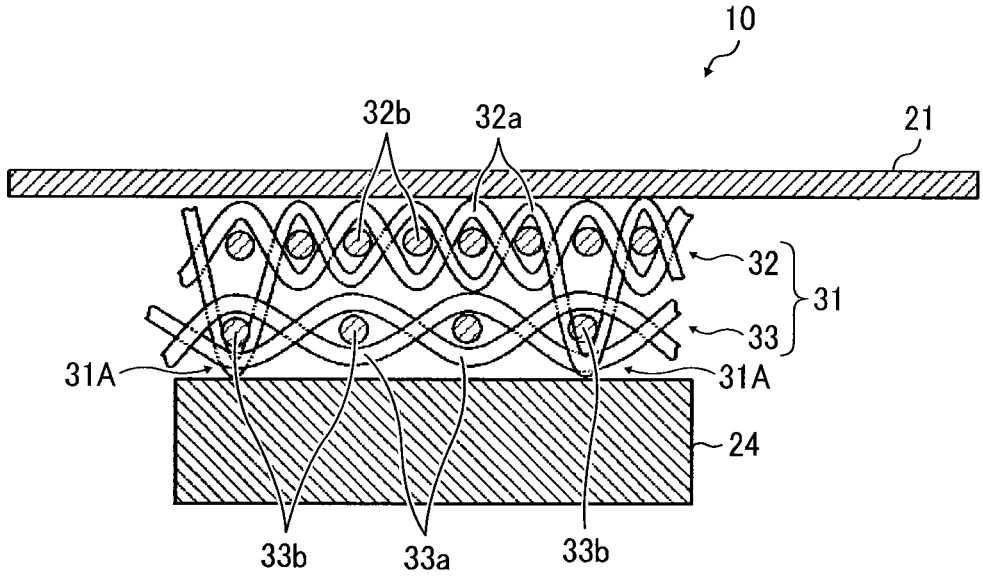
FIG. 4 is a cross-sectional view illustrating a schematic configuration of a sliding pad provided in the fixing device according to the first embodiment of the present invention.

Here, as shown in FIGS. 3 and 4, a sliding pad 31 is placed between the fixing nip-forming member 25 and the inner circumferential surface of the fixing belt 21 in the fixing unit 10, while retaining the lubricant therein to render the fixing belt 21 to smoothly slide thereon. The sliding pad 31 includes a first fibrous layer 32 located in contact with the inner circumferential surface of the fixing belt 21 and a second fibrous layer 33 having fiber density less than that of the first fibrous layer 32 located closer to the fixing nip-forming member 25 than the first fibrous layer 32. Thus, in this embodiment, the sliding pad 31 includes a two-layer structure composed of the first and second fibrous layers 32 and 33.

In the sliding pad 31, the first fibrous layer 32 in contact with the inner circumferential surface of the fixing belt 21 is composed of a woven fabric woven from threads of warp 32*a* and weft 32*b* each composed of a fiber made of fluorine resin, such as PTFE, PFA, ETFE, FEP, etc., to reduce frictional resistance caused between the fixing belt 21 and itself. Similarly, the second fibrous layer 33 not contacting the inner circumferential surface of the fixing belt 21 is composed of a woven fabric woven from threads of warp 33*a* and weft 33*b* each composed of a fiber made of such as PPS, aramid, nylon, etc., having good lubricant retention.

In this embodiment, the first fibrous layer 32 is typically composed of the PTFE resin fiber. By contrast, the second fibrous layer 33 is composed of the PPS resin fiber, for example.

Figure 5:
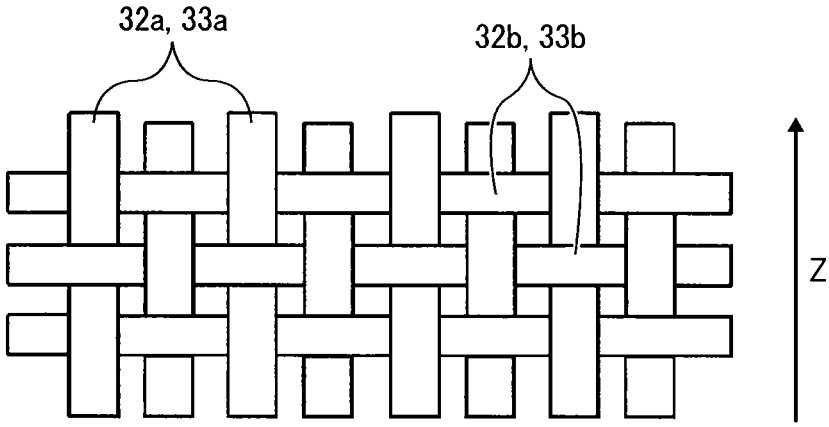
FIG. 5 is a plan view illustrating a plainly weaving manner as one example of weaving fibers employed in the fixing device according to the first embodiment of the present invention.

Further, as shown in FIG. 5, the first and second fibrous layers 32 and 33 in this embodiment are composed of woven fabrics, respectively, prepared by flatly weaving threads of warps 32*a* and 33*a* and wefts 32*b* and 33*b* while alternately passing these threads up and down, for example. Further, the fixing belt 21 runs in a warp direction of the sliding pad 31, specifically, along the warps of the first and second fiber fibrous layers 32 and 33.

Here, the sliding pad 31 preferably includes a laminate structure not to block and easily allow movement of the lubricant impregnated in the second fibrous layer 33 to the first fibrous layer 32. Thus, the sliding pad 31 is preferably integrated by not bonding surfaces of these two first and second fibrous layers 32, 33 using adhesive. Thus, as shown in FIG. 4, in the sliding pad 31 of this embodiment, the two layers are integrated by interweaving the threads of warp 32*a* of the first fibrous layer 32 and threads of weft 33*b* of second fibrous layer 33 with each other at multiple junctions 31A, and, although not shown, the threads of warp 32*b* of the first fibrous layer 32 and the threads of weft 33*a* of the second fibrous layer 33 with each other at multiple joints, respectively.

However, only a combination of the threads of warp 32*a* of the first fibrous layer 32 and those of weft 33*b* of the second fibrous layer 33 or that of the threads of weft 32*b* of the first fibrous layer 32 and those of warp 33*a* of the second fibrous layer 33 can be interwoven.

Further, as shown in FIG. 4, fiber density of the sliding pad 31 is about 0.5 degree of that the second fibrous layer 33, for example. Here, since the fibrous layer composed of the woven fabric retains lubricant impregnated therein and a percentage of a vacancy other than the fiber is inversely proportional to the fiber density, a considerable amount of the lubricant can be retained when the fiber density is reduced. In this embodiment, since the fiber density of the second fibrous layer 33 is higher (lower) than that of the first fibrous layer 32, and accordingly, the vacancy rate (i.e., the percentage of the vacancy other than the fiber) of the second fibrous layer 33 is higher than that of the first fibrous layer 32, the second fibrous layer 33 can retain more of the lubricant. Further, since the fiber density of the first fibrous layer 32 is higher than that of the second fibrous layer 33, the vacancy rate of the first fibrous layer 32 is lower than that of the second fibrous layer 32, the fiber density of the first fibrous layer 32 can reduce an amount of the lubricant to squeeze out therefrom upon receiving pressure. Further, for the same reason, the first fibrous layer 32 can prevent the lubricant retained in the second fibrous layer 33 from being squeezed out therefrom by the pressure. Further, for the same reason again, durability of the sliding pad 31 on the side of the fixing belt 21*e* can be upgraded.

The nip-forming member 25 only needs a heat-resistance under usage temperature and may be made of inorganic or organic material capable of transferring pressure. For example, nip-forming member 25 is made of inorganic material (e.g. ceramic, glass, aluminum), rubber (e.g., silicone rubber, fluorine rubber), fluorine resin (e.g., PTFE (tetrafluoroethylene), PFA (fluorine ethylene-perfluoroalkoxyvinyl ether copolymer), ETFE (ethylene-tetrafluoride ethylene copolymer), FEP (tetrafluoroethylene-hexafluorophosphate propylene copolymer)), plastic (PI (polyimide), PAI (polyamide imide), PPS (polyphenylene sulfide), PEEK (Polyether ether ketone), LCP (liquid plastic, liquid crystal polymers), phenolic resin, nylon and aramid), combinations of these, etc. In this embodiment, the fixing nip-forming member 25 is typically made of liquid crystal polymer (LCP).

The sliding pad 31 is impregnated with lubricant, and the lubricant is supplied to a gap between the fixing belt 21 and the sliding pad 31. As the lubricant, to reduce friction, material containing silicone oil or denatured perfluoropolyether, such as carboxylic acid denatured perfluoropolyether, phosphate denatured perfluoropolyether, alcohol denatured perfluoropolyether, amide denatured perfluoropolyether, etc., can be used.

Further, to prevent spillage and diffusion of the lubricant to the other parts, a thickening agent may also be added thereto to enhance ability to retain an oil component thereof. As the thickening agent, for example, Benton, silica gel, urea, PTFE, molybdenum disulfide, glass, and carbon, BN or the like are used. Especially, the PTFE particles having affinities for the denatured perfluoropoly ether capable of maintaining sliding performance is preferable among those of agents. Thus, the addition of the thickening agent to the lubricant can prevent diffusion of the oil (i.e., lubricant).

The sliding pad 31 is integrally fixed to the fixing nip-forming surface 25*a* of the fixing nip-forming member 25 so as not to relatively shift to and from the fixing nip-forming member 25. In this embodiment, the second fibrous layer 33 of the sliding pad 31 is integrated with the fixing nip-forming member 25 by heat sealing, for example.

Figure 6:
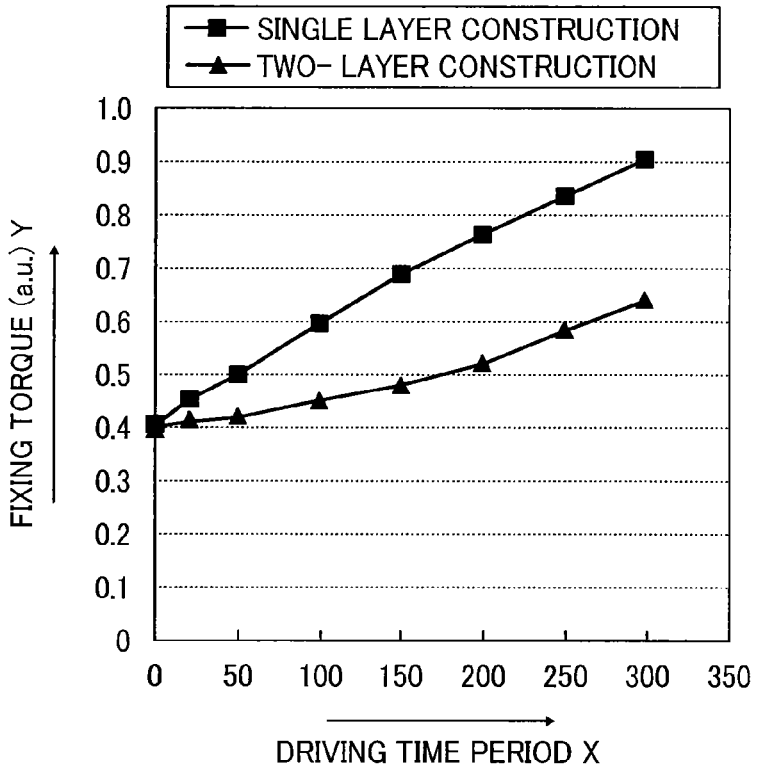
FIG. 6 is a graph illustrating an exemplary relation between a driving time and a fixing torque obtained in the fixing device according to the first embodiment of the present invention.
Figure 7:
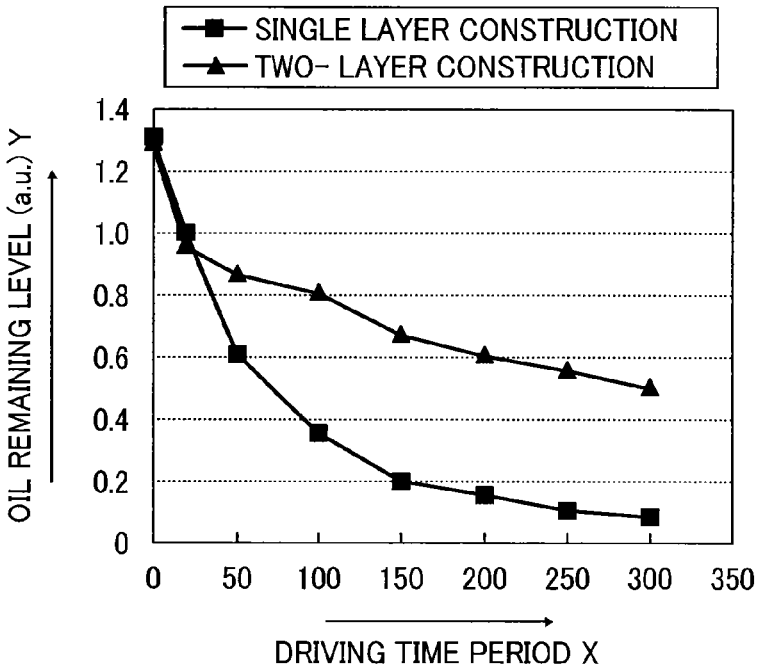
FIG. 7 is a graph illustrating an exemplary relation between a driving time and a lubricant remaining amount obtained in the fixing device according to the first embodiment of the present invention.

Now, FIG. 6 is a diagram illustrating an example of a relation between a driving time and a fixing torque obtained in the fixing device 10 according to this embodiment. FIG. 7 is a diagram showing an example of a relation between the driving time and a lubricant remaining level obtained in the fixing device 10 according to this embodiment. Data is obtained in the embodiment under the below described conditions.

Firstly, as the release layer 21 of the fixing belt 21, a PFA coat having a thickness about 30 μm is used. As the elastic layer 21*b* of the fixing belt 21, silicon rubber having a thickness about 250 μm is used. As a belt 21*c* of the fixing belt 21, a thin-film substrate made of stainless steel having a diameter of about 30 mm and a thickness of about 40 μm are used.

Secondly, as the release molding layer 22*c* of the pressing roller 22, a PFA tube having a thickness of about 30 μm is used. As the elastic layer 22*b* of the pressing roller 22, a silicone rubber foam member having a thickness of about 3.5 mm is used. As the roller 22*a* of the pressing roller 22, a SUS24 (free cutting steel) is used.

Thirdly, as the fixing nip-forming member 25, LCP resin is used. Fourthly, as the first fibrous layer 32 of the sliding pad 31, woven fabric composed of PTFE fiber is used. As the second fibrous layer 33 of the sliding pad 31, a woven fabric composed of a PPS fiber is used. Here, a rate of fiber density between the first and second fibrous layers 32 and 33 is about 1 versus 0.5. Further, about 1.3 g of silicone oil is impregnated in the second fibrous layer 33 as the lubricant. Further, a total weight of about 30 kgf is applied to the fixing nip-forming member 25 from the side of the pressing roller 22. Fifthly, the fixing nip N is heated at 160° C. by the heater 23. A peripheral speed thereof is about 250 mm/s.

Here, the oil level shown in FIG. 7 is obtained and plotted therein by measuring a change in weight of the sliding pad 31, in which about 1.3 g (at an initial stage) of the silicone oil is impregnated, as time elapses.

Further, in FIGS. 6 and 7, data of a single layer configuration represented by rectangular dots is obtained under conditions in which the same configuration as the first fibrous layer 32 is used and a woven fabric having the same thickness as the sliding pad 31 is employed. By contrast, data of the two-layer configuration represented by triangle dots is obtained under a condition in which the above-described sliding pad 31 is used.

As shown in FIG. 6, a fixing torque of the single layer configuration indicates about 0.9 (a.u: an arbitrary unit) when 300 hours have elapsed. By contrast, a fixing torque of the two-layer configuration indicates about 0.63 (a.u: an arbitrary unit) when 300 hours have elapsed with reduction of about 30% from the single layer configuration. Further, as shown in FIG. 7, an oil retention volume of the single layer configuration decreases by about 1.25 (a.u: an arbitrary unit). By contrast, the two-layer configuration decreases by only about 0.8 (a.u: arbitrary units) with reduction of approximately 35%. Accordingly, since a rate of the vacancy other than the fiber is inversely proportional to the fiber density, to impregnate more of the oil to it, the fiber density of the second fibrous layer 33 may be further reduced.

Further, when the fiber density is excessively reduced, strength of the fibrous layer is extremely reduced. Here, the PTFE fiber generally includes tensile strength of from about 20 Mpa to about 35 Mpa having a tensile modulus of elasticity of from about 0.4 Mpa to about 0.55 Mpa. By contrast, the PPS fiber includes tensile strength of from about 160 Mpa to about 200 MPa having a tensile modulus of from about 14 Mpa to about 20 Mpa to be stronger than the PTFE fiber. Thus, when the PTFE fiber and the PPS fiber are used as is used as the first and the second fibrous layers 32 and 33, respectively, the rate of the fiber density between the first and second fibrous layers 32 and 33 is preferable when it is about 1 versus 0.3 or more.

Further, in the fixing nip N, tensile shearing force occurs in the sliding pad 31 as the fixing belt 21 brought in pressure contact therewith runs. In this situation, it is known that when the fiber strength is relatively weak, the fiber itself deforms, and accordingly, the lubricant stored therein leaks therefrom. Since the fiber strength relies especially on strength of the threads of warp (i.e., the fibers extended in the direction of sliding movement) and is ensured by any one of the first and second fibrous layers 32 and 33, the second fibrous layer 33 capable of enhancing the fiber strength preferably retains the lubricant (rather than the first one).

Further, as mentioned above, the first and second fibrous layers 32 and 33 of the sliding pad 31 are made of the PTFE resin fiber and the PPS resin fiber, for example, respectively. Specifically, the second fibrous layer 33 of the sliding pad 31 includes a higher elastic modulus than that of the first fibrous layer 32. In this situation, because the first fibrous layer 32 includes the lower elastic modulus than that of the second fibrous layer 33, it tightly and uniformly contacts the fixing belt 21 and uniformly applies pressure to the fixing nip N when it receives the pressure from the pressing roller 22. On the other hand, since the second fibrous layer 33 includes the higher elastic modulus than that of the first fibrous layer 32, deformation and a change in the vacancy density of the fiber rarely occur, and accordingly, the lubricant retained between the fibers (i.e., the vacancy other than the fiber) is hardly drained.

Further, in the fixing unit 10, material of a contact section of the sliding pad 31, which contacts the fixing nip-forming member 25, includes a lower melting point than that contacting the fixing belt 21. Also, the fixing nip-forming member 25 is made of material having a lower melting point than the contact section of the sliding pad 31, which contacts the fixing belt 21.

Here, a melting point of the PPS resin used as the material of the first fibrous layer 32 serving as the contact section of the sliding pad 31 which contacts the fixing belt 21 is approximately 280° C. By contrast, a melting point of the PTFE resin used as material of the second fibrous layer 33 serving as the contact section of the sliding pad 31 which contacts the fixing nip-forming member 25 is approximately 320° C. Further, a melting point of liquid crystal polymer used as material of the fixing nip-forming member 25 is from about 280° C. to about 320° C.

Since the fixing nip-forming member 25 and the sliding pad 31 are composed of such materials and accordingly melt at thermal melting points of from about 280° C. to about 320° C., these parties can be integrated by heat sealing at low cost.

Now, a basic operation of the above-described color image forming apparatus 1 is described with reference to FIG. 1.

When the color image forming apparatus 1 starts image formation, each of photoconductive drums 4*d* of the process units 4Y, 4C, 4M, and 4Bk 4*d* is driven and rotated clockwise in the drawing by a driving mechanism, not shown. Each of surfaces of the photoconductive drums 4*d* is subsequently charged uniformly by each of charging rollers 4*r* to have a given polarity. Subsequently, to the surfaces of the charged photoconductive drum 4*d*, a laser light beam is irradiated from the optical writing system 3, so that electrostatic latent images are formed thereon. At this moment, chromatic image information of yellow, cyan, magenta, and black obtained by separating full-color of an image is written onto the respective photoconductive drums 4*d*. Thus, as toner is supplied by each of the developer devices 4*g* to each of the electrostatic latent images formed on the photoconductive drums 4*d*, the electrostatic latent images are rendered visible to be toner images (i.e., developed images), respectively.

Further, when the driving roller 5*b* is driven and rotated counter clockwise, the transfer belt 5*a* is driven in a direction as shown by arrow in the drawing. Further, to each of the primary transfer rollers 5*d*, a voltage having been subjected to constant voltage or current control having an opposite polarity to a polarity of charged toner is applied. Hence, an electric transfer field is formed in each of primary transfer nips formed between the primary transfer rollers 5*d* and the photoconductive drums 4*d*, respectively.

Further, the color toner images formed on the photoconductive drums 4*d* in the respective process units 4Y, 4C, 4M, and 4Bk are subsequently transferred and superimposed successively on the transfer belt 5*a* under influence of the electric transfer fields formed in the above-described respective primary transfer nips. In this way, the transfer belt 5*a* bears a full-color toner image on its front surface.

Further, residual toner adhering to the surfaces of the photoconductive drums 4*d* after the toner image transfer process is removed by the cleaning blades 4*b*, respectively. Subsequently, electric charge remaining on each of the surfaces of the respective photoconductive drum 4*d* is removed by each of the charge removing units, not shown, so that each of surface potentials of the surfaces of the respective photoconductive drum 4*d* is initialized to prepare for the next image formation thereon.

Further, when the developing devices affix toner to the electrostatic latent images formed on each of the photoconductive drums 4*d* thereby starting image formation to form toner images, a sheet feeding roller 7*b* placed at the bottom of the color image forming apparatus 1 is rotated and driven. With the rotation and driving of the sheet feeding roller 7*b*, a recording sheet S stored in the sheet feeding device 7 is sent and launched into the sheet conveying path R. The recording sheet S sent to the sheet conveying path R is timed by a registration roller 9, and is further sent to a secondary transfer nip formed between the secondary transfer roller 5*e* and the driving roller 5*b* opposed thereto. Here, a transfer voltage having an opposite polarity to that of the polarity of charged toner included in the toner image borne on the transfer belt 5*a* is applied to the secondary transfer roller 5*e*, so that an electric transfer field is formed in the secondary transfer nip.

Further, the toner image on the transfer belt 5*a* is subsequently transferred onto the recording sheet S at once under influence of the electric transfer field formed in the secondary transfer nip. The recording sheet S with the transferred toner image thereon in this way is subsequently conveyed to the fixing device 10 and is heated and pressed by the fixing belt 21 and the pressing roller 22, respectively, so that the toner image is ultimately fixed thereon. Here, when the recording sheet S is conveyed to the fixing device 10, radiant heat is directly transferred from the heater 23 to the fixing belt 21.

The record sheet S with the fixed toner image is subsequently separated from the fixing belt 21 by a separating mechanism, not shown, and is ejected by a sheet exiting roller 8*b* onto the tray 8*a* in the sheet exiting tray unit 8. Further, residual toner remaining on the transfer belt 5*a* after the secondary transfer process is subsequently removed by a belt cleaning device 6, and is transported and collected in the waste toner container.

Further, although the above-described image formation is executed to form the full-color image on the recording sheet S, a monochromatic image can be formed by using one of the four process units 4Y, 4C, 4M, and 4Bk as well. Further, twin or trivalent color images can also be formed by using two or three process units among these four process units 4Y, 4C, 4M, and 4Bk as well.

Since the fixing device 10 according to this embodiment is configured as described above, the below described advantages can be obtained.

That is, the fixing device 10 according to this embodiment includes a sliding pad 31 placed between the fixing nip-forming member 25 and the fixing belt 21 to retain the lubricant and render the fixing belt 21 to smoothly slide thereon therewith. Furthermore, the sliding pad 31 includes the first fibrous layer 32 located in contact with the inner circumferential surface of the fixing belt 21 and the second fibrous layer 33 located closer to the fixing nip-forming member 25 than the first fibrous layer 32 while having fiber density less than that of the first fibrous layer 32.

With such a configuration, since the fiber density of the second fibrous layer 33 is lower than that of the first fibrous layer 32, and accordingly, the vacancy rate (i.e., the percentage of vacancy other than the fiber) of the second fibrous layer 33 is higher than that of the first fibrous layer 32, the second fibrous layer 33 can retain more of the lubricant therein. By contrast, since the fiber density of the first fibrous layer 32 is higher than that of the second fibrous layer 33, the vacancy rate of the first fibrous layer 32 is lower than that of the second fibrous layer 32, the first fibrous layer 32 can reduce an amount of lubricant to squeeze out therefrom by pressure. Further, the first fibrous layer 32 having higher fiber density can likely suppress an amount of the lubricant retained in the second fibrous layer 33 to be squeezed out by the pressure. That is, since the fixing device 10 according to this embodiment can enhance a volume of lubricant to retain in the sliding pad 31 while reducing an amount of leakage of the lubricant therefrom, retention performance of retaining the lubricant for a long time can be upgraded. As a result, a fixing device 10 capable of steadily driving a fixing belt for a long and a color image forming apparatus 1 with the fixing device 10 can be provided.

Further, according to this embodiment of the fixing device 10, since the fiber density of the first fibrous layer 32 is higher than that of the second fibrous layer 33, durability of the contact section of the sliding pad 31 contacting the fixing belt 21 can be upgraded.

Further, according to this embodiment of the fixing device 10, the second fibrous layer 33 located closer to the fixing nip-forming member 25 includes the higher elastic modulus than that of the first fibrous layer 32 as described earlier.

With such a configuration, because the first fibrous layer 32 includes the lower elastic modulus than that of the second fibrous layer 33, and accordingly, it can tightly and uniformly contact the fixing belt 21, the first fibrous layer 32 can uniformly apply pressure to the fixing nip N when it receives the pressure from the pressing roller 22. As a result, quality of a fixing image can be upgraded. On the other hand, since the second fibrous layer 33 includes the higher elastic modulus than that of the first fibrous layer 32, and deformation and a change in density of the fiber rarely occur, and accordingly, the lubricant retained between the fibers (i.e., a vacancy other than the fiber) is hardly drained, retention performance of retaining the lubricant for a long time can be upgraded. Further, the sliding pad 31 can be strengthened.

Further, according to this embodiment of the fixing device 10, the first and second fibrous layers 32 and 33 are configured by the woven fabrics, respectively, each flatly woven from threads of warp and weft by alternately passing these threads up and down, for example. Furthermore, the fixing belt 21 runs in a direction along the threads of warps 32*a* and 33*a* of the respective first and second fiber fibrous layers 32 and 33.

With such a configuration, since tensile strength of the sliding pad 31 in a running direction of the fixing belt is upgraded, leakage of the lubricant from the sliding pad 31, which is generally caused by distortion of the sliding pad 31, can be likely suppressed.

Further, according to this embodiment of the fixing device 10, the first and second fibrous layers 32 and 33 are integrated by intertwining respective fibers of the woven fabrics.

With such a configuration, since the lubricant retained in the second fibrous layer 33 can be easily moved to the first fibrous layer 32, retention performance of retaining the lubricant for a long time can be more upgraded.

Further, according to this embodiment of the fixing device 10, the sliding pad 31 is integrally fixed to the fixing nip-forming member 25 not to relatively shift to and from the fixing nip-forming member 25.

With such a configuration, since leakage of the lubricant from the sliding pad 31, which is generally caused by expansion and contraction of the sliding pad 31, can be likely suppressed, retention performance of retaining the lubricant for a long time can be more upgraded.

Further, according to the embodiment of the fixing device 10, materials of the contact section of the sliding pad 31, which contacts the fixing nip-forming member 25, includes the lower melting point than that of the other contact section contacting the fixing belt 21, and the fixing nip-forming member 25 is made of the material having the lower melting point than that of the contact section of the sliding pad 31, which contacts the fixing nip-forming member 25.

With such a configuration, the sliding pad 31 can be integrated with the fixing nip-forming member 25 by heat sealing at low cost.

Hence, although in the above-described embodiment, an internal heating system, in which the heater 23 is positioned inside the loop of the fixing belt 21 while separating therefrom, the present invention is not limited to it. Specifically, an external heating system, in which an IH heater (not shown) is positioned outside the loop of the fixing belt 21 while separating therefrom, can be employed as well.

Now, a second embodiment is described with reference to FIG. 8. A fixing device 10A according to this embodiment includes essentially the same configuration as the first embodiment except for the followings.

Figure 8:
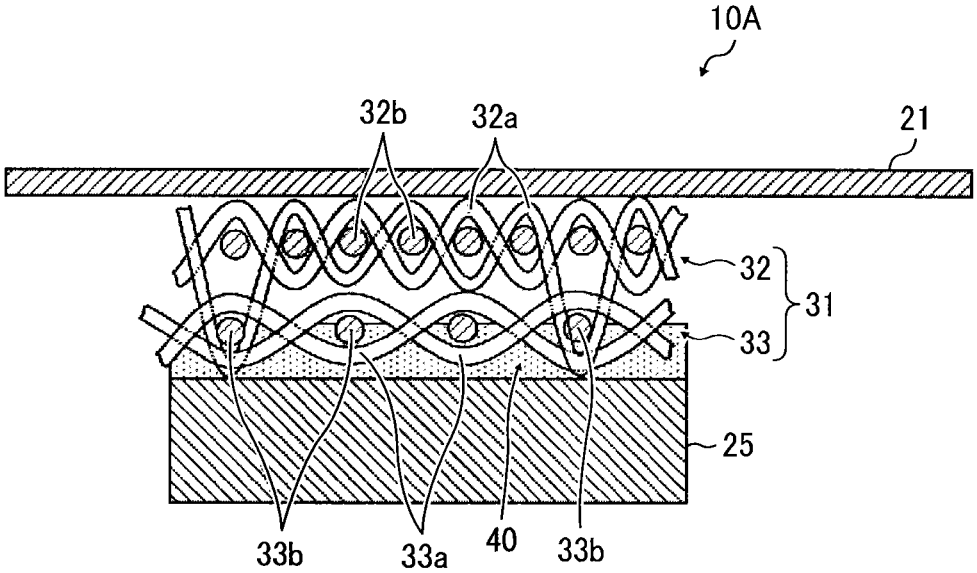
FIG. 8 is a cross-sectional view illustrating a schematic configuration of a sliding pad provided in a fixing device according to a second embodiment of the present invention.

Specifically, as shown in FIG. 8, in the fixing device 10A of this embodiment, a part of the sliding pad 31 located closer to the fixing nip-forming member 25 is adhered and secured to the fixing nip-forming member 25 with adhesive 40 so that the sliding pad 31 and the fixing nip-forming member 25 can be integrated not to change relative positions of these parties. That is, the second fibrous layer 33 of the sliding pad 31 is bonded and fastened to the fixing nip-forming member 25 with adhesive 40. As the adhesive 40, heat-resistant epoxy resin adhesive, Silicone adhesive, and fluorine adhesive or the like can be used, for example. Further, material of the adhesive 40 is preferable if it has viscosity as high as possible to be able to suppress its penetration into the sliding pad 31, especially into the second fibrous layer 33. Here, the lubricant is impregnated in the sliding pad 31 after the second fibrous layer 33 of the sliding pad 31 is bonded to the fixing nip-forming member 25.

Hence, according to this embodiment of the fixing device 10A, since the sliding pad 31 and the fixing nip-forming member 25 are integrally bonded and fixed to each other not to change the relative positions of these parties via the adhesive 40, leakage of the lubricant from the sliding pad 31, which is generally caused by expansion and contraction of the sliding pad 31, can be likely suppressed. As a result, retention performance of retaining the lubricant for a long time can be more upgraded again in this embodiment of the fixing device 10A as well.

Further, in the fixing device 10A, the part of the sliding pad 31 located closer to the fixing belt 21 has a lower energy than that of the other part thereof located closer to the fixing nip-forming member 25. Further, the surface energy can be represented, in other words, by tightly contacting performance or wetting performance. Furthermore, when chemical adsorption or chemical reaction is caused on a surface of an object, the object inherently increasingly tends to adhere to another object as degrees of the chemical adsorption or chemical reaction increase. Thus, the surface energy is high when the chemical reaction is easily caused, and low when it is unlikely caused, respectively.

A surface of the object inherently tends to move in a direction minimizing its free energy. Since an object having high surface energy tends to decrease its free energy by contacting the other substance, wetting performance thereof can be enhanced. By contrast, an object having low surface energy becomes more stable when it is exposed than it contacts the other substance in a point of energy view. Thus, the wetting performance and the tightly contacting performance of the object are degraded.

Here, the surface energy is measured by a contact angle as a substitute. The contact angle of water regarding each of the PTFE fiber and PPS fiber is as follows. Firstly, the contact angle of the PTFE fiber is about 114 degrees, and thus the surface energy thereof is relatively low. Secondly, the contact angle of the PPS fiber is about 30 degrees and thus the surface energy thereof is relatively high.

Further, in the sliding pad 31, the first fibrous layer 32 is composed of the PTFE fiber, for example. By contrast, the second fibrous layer 33 is composed of the PPS fiber, for example. Accordingly, the surface energy of the part of the sliding pad 31 located closer to the fixing belt 21 is less than the part thereof located closer to the fixing nip-forming members 25.

In this way, since the surface energy of the part of the sliding pad 31 closer to the fixing belt 21 is less than that of the other portion thereof located closer to the fixing nip-forming members 25 in the fixing device 10A of this embodiment, the part of the sliding pad 31 located closer to the fixing belt 21 provides low friction and rarely attracts a foreign object while upgrading the tightly contacting performance in the other part located closer to the fixing nip-forming member 25.

Hence, the above-described system specifying a relation of the surface energy is particularly effective in this embodiment employing the adhesive 40. However, the above-described system is also effective when it is applied to the first embodiment, in which the fixing nip-forming member 25 and the sliding pad 31 are connected to each other by heat sealing.

Now, a third embodiment is described with reference to FIG. 9. A fixing device 10B according to this embodiment includes essentially the same configuration as the first embodiment except for the followings.

Figure 9:
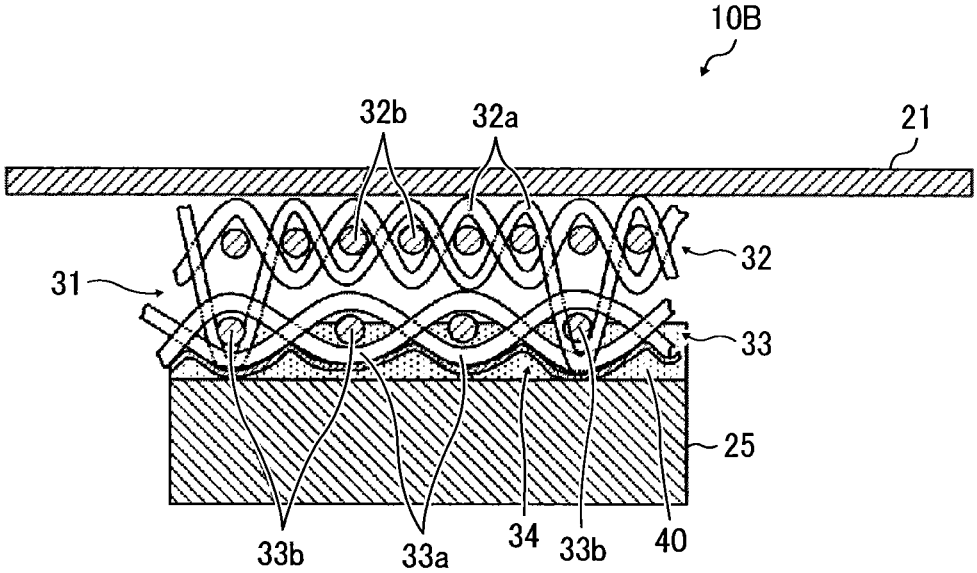
FIG. 9 is a cross-sectional view illustrating a schematic configuration of a sliding pad provided in the fixing device according to a third embodiment of the present invention.

Specifically, as shown in FIG. 9, in the fixing device 10B of this embodiment, a part of the sliding pad 31 located closer to the fixing nip-forming member 25 is adhered and secured to the fixing nip-forming member 25 via the adhesive 40 so that the sliding pad 31 and the fixing nip-forming member 25 do not change position. In addition, a penetration preventing film 34 is provided in the part of the sliding pad 31 located closer to the fixing nip-forming member 25 to prevent penetration of the adhesive 40 into the sliding pad 31. The penetration prevention film 34 is affixed to a surface of the second fibrous layer 33 facing the fixing nip-forming member 25.

Hence, according to this embodiment of the fixing 10B, since the penetration preventing film 34 is provided in the part of the sliding pad 31 located closer to the fixing nip-forming member 25 to prevent penetration of the adhesive 40, the adhesive 40 is prohibited to penetrate into the second fibrous layer 33 and thereby reducing the number of vacancies to retain the lubricant even when the fixing nip-forming member 25 and the sliding pad 31 are united using the adhesive 40. Further, the adhesive 40 is also prohibited to penetrate into the first fibrous layer 32 and thereby degrading sliding performance of the fixing belt 21 as well.

In the described embodiments, the fixing nip-forming member 25 and the sliding pad 31 are described as independent parts independent from each other. However, the present invention is not limited thereto, and can be adopted in a fixing device in which the sliding pad 31 is included in the fixing nip-forming member 25.

Further, as described heretofore, according to one embodiment of the present invention, since the fixing belt can be driven steadily for a long time in the fixing device, the fixing device itself and an image forming apparatus, such as a copier, a facsimile machine, a printer, etc., with the fixing device are particularly useful.

Now, a fourth embodiment is described with reference to FIG. 10. A fixing device 10C according to this embodiment includes essentially the same configuration as the first embodiment except for the followings.

Figure 10:
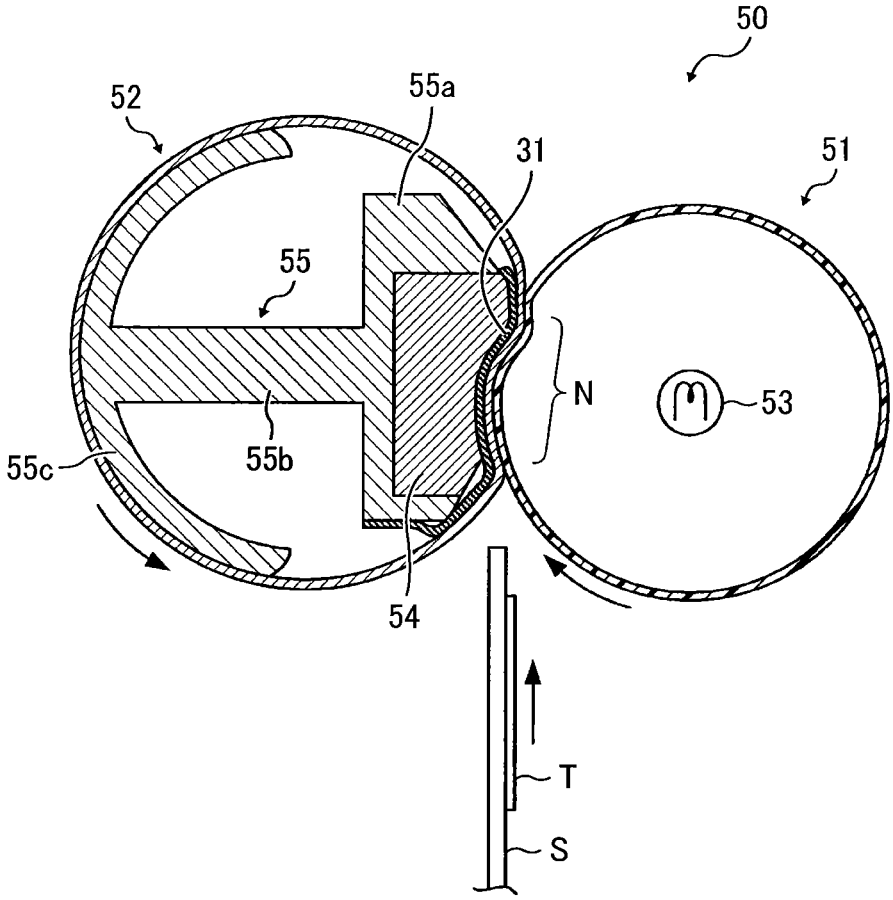
FIG. 10 is a schematic cross-sectional view illustrating an exemplary configuration of the fixing device according to a fourth embodiment of the present invention.

Specifically, as shown in FIG. 10, the fixing device 50 includes a fixing roller 51 acting as a fixing member and a driving source, a pressing belt 52 driven and rotated by contacting the fixing roller 51 to act as a pressing member, and a heater 53 as a heat source. The fixing device 50 further includes a nip-forming member 54 disposed inside a loop of an inner circumferential surface of the pressing belt 52 to together form a nip N with the fixing roller 51 via the pressing belt 52, a supporting member 55 that supports the fixing nip-forming member 54, and a sliding pad 31 that retains the lubricant and renders the pressing belt 52 to smoothly slide thereon.

The nip-forming member 54 is composed of a pad like member having elasticity to effectively form a nip N along a curvature of the fixing roller 51.

The supporter 55 includes a pad supporting section 55*a* that supports the fixing nip-forming member 54, a stay section (or a wall section) 55*b* extended to an opposite side of the pad supporting section 55*a* therefrom passing through an axis, a supporting frame 55*c* either integral with or separate from the stay section 55*b* on the opposite side of the fixing nip-forming member 54 to support an inner circumferential surface of the pressing belt 52.

Also with such a configuration, the lubricant is impregnated and retained in the sliding pad 31 as well, and is accordingly provided to a gap between the pressing belt 52 and the sliding pad 31 to reduce friction, which is generally caused therebetween.

According to one embodiment of the present invention, a fixing device and an image forming apparatus with the fixing device can steadily drive a fixing belt for a long time.

Numerous additional modifications and variations of the present invention are possible in light of the above teachings. It is therefore to be understood that within the scope of the appended claims, the present invention may be executed otherwise than as specifically described herein. For example, the order of steps for forming the image forming apparatus is not limited to the above-described various embodiments and can be appropriately changed.

What is claimed is:

1. A fixing device to fix an unfixed image onto a recording medium by heating the recording medium, the fixing device comprising:

a rotator;

a fixing belt contacting the rotator and rotatable by rotation of the rotator;

a fixing nip-forming member provided inside a loop of the fixing belt to together form a fixing nip with the rotator via the fixing belt; and a sliding pad placed between the fixing nip-forming member and the fixing belt to retain lubricant and render the fixing belt to smoothly slide thereon, wherein the sliding pad comprises:

a first fibrous layer contacting the fixing belt; and a second fibrous layer closer to the fixing nip-forming member than the first fibrous layer, the second fibrous layer having less fiber density than the first fibrous layer.

2. The fixing device as claimed in claim 1, wherein the second fibrous layer includes a higher elastic modulus than the first fibrous layer.

3. The fixing device as claimed in claim 1, wherein the first fibrous layer and the second fibrous layer are composed of plainly woven fabrics, respectively, each produced by weaving threads of warp and weft up and down alternatingly, and wherein the fixing belt travels along the threads of warp of the sliding pad.

4. The fixing device as claimed in claim 1, wherein the first fibrous layer and the second fibrous layer are integrated by intertwining the threads of the first fibrous layer and the second fibrous layer with each other.

5. The fixing device as claimed in claim 1, wherein the sliding pad is fixedly mounted to the fixing nip-forming member.

6. The fixing device as claimed in claim 1, wherein a part of the sliding pad contacting the fixing nip-forming member is made of material having a lower melting point than that of another part of the sliding pad contacting the fixing belt, wherein the fixing nip-forming member is made of material having a lower melting point than that of a part of the sliding pad contacting the fixing nip-forming member.

7. The fixing device as claimed in claim 1, wherein the sliding pad is bonded to the fixing nip-forming member with adhesive, further comprising a penetration preventing film to prevent penetration of the adhesive, the penetration preventing film provided in a part of the sliding pad located closer to the fixing nip-forming member.

8. The fixing device as claimed in claim 1, wherein a part of the sliding pad located closer to the fixing belt includes a lower surface energy than another part of the sliding pad located closer to the fixing nip-forming member.

9. An image forming apparatus comprising:

an image forming system a fixing device to fix an unfixed image onto a recording medium by heating the recording medium, the fixing device comprising:

a rotator;

a belt contacting the rotator and rotatable by rotation of the rotator;

a fixing nip-forming member provided inside a loop of the fixing belt to together form a fixing nip with the rotator via the fixing belt; and a sliding pad placed between the fixing nip-forming member and the fixing belt to retain lubricant and render the fixing belt to smoothly slide thereon, wherein the sliding pad comprises:

a first fibrous layer contacting the fixing belt; and a second fibrous layer closer to the fixing nip-forming member than the first fibrous layer, the second fibrous layer having less fiber density than the first fibrous layer.

10. The image forming apparatus as claimed in claim 9, wherein the second fibrous layer includes a higher elastic modulus than the first fibrous layer.

11. The image forming apparatus as claimed in claim 9, wherein the first fibrous layer and the second fibrous layer are composed of plainly woven fabrics, respectively, each produced by weaving threads of warp and weft up and down alternatingly, and wherein the fixing belt travels along the threads of warp of the sliding pad.

12. The image forming apparatus as claimed in claim 9, wherein the first fibrous layer and the second fibrous layer are integrated by intertwining the threads of the first fibrous layer and the second fibrous layer with each other.

13. The image forming apparatus as claimed in claim 9, wherein the sliding pad is fixedly mounted to the fixing nip-forming member.

14. The image forming apparatus as claimed in claim 9, wherein a part of the sliding pad contacting the fixing nip-forming member is made of material having a lower melting point than that of another part of the sliding pad contacting the fixing belt, wherein the fixing nip-forming member is made of material having a lower melting point than that of a part of the sliding pad contacting the fixing nip-forming member.

15. The image forming apparatus as claimed in claim 9, wherein the sliding pad is bonded to the fixing nip-forming member with adhesive, further comprising a penetration preventing film to prevent penetration of the adhesive, the penetration preventing film provided in a part of the sliding pad located closer to the fixing nip-forming member.

16. The image forming apparatus as claimed in claim 9, wherein a part of the sliding pad located closer to the fixing belt includes a lower surface energy than another part of the sliding pad located closer to the fixing nip-forming member.

17. A fixing device to fix an unfixed image onto a recording medium by heating the recording medium, the fixing device comprising:

a rotator;

a fixing belt contacting the rotator and rotatable by rotation of the rotator;

means for together forming a fixing nip with the rotator via the fixing belt, the nip-forming means provided inside a loop of the fixing belt;

means for retaining lubricant and rendering the fixing belt to smoothly slide thereon, the lubricant retaining means placed between the fixing nip-forming means and the fixing belt, wherein the lubricant retaining means comprises:

first fibrous means contacting the fixing belt; and second fibrous means contacting the fixing nip-forming means, the second fibrous means having less fiber density than the first fibrous means.

* * * * *